US012312045B1

(12) United States Patent
Stevens et al.

(10) Patent No.: US 12,312,045 B1
(45) Date of Patent: May 27, 2025

(54) STEADY DOCKING WHIP

(71) Applicant: Bow & Stern, Inc., Allentown, PA (US)

(72) Inventors: Samuel Lewis Graham Stevens, Ithaca, NY (US); Liam F. Pillsbury, Providence, RI (US)

( * ) Notice: Subject to any disclaimer, the term of this patent is extended or adjusted under 35 U.S.C. 154(b) by 597 days.

(21) Appl. No.: 17/680,771

(22) Filed: Feb. 25, 2022

Related U.S. Application Data

(60) Provisional application No. 63/155,703, filed on Mar. 2, 2021.

(51) Int. Cl.

| | |
|---|---|
| ***B63B 21/04*** | (2006.01) |
| ***B63B 21/00*** | (2006.01) |
| ***B63B 21/20*** | (2006.01) |
| ***E02B 3/24*** | (2006.01) |

(52) U.S. Cl.
CPC ..... *B63B 21/04* (2013.01); *B63B 21/00* (2013.01); *B63B 21/20* (2013.01); *E02B 3/24* (2013.01); *B63B 2021/203* (2013.01)

(58) Field of Classification Search
CPC ..... B63B 21/00; B63B 2021/001; B63B 2021/002; B63B 2021/003; B63B 21/04; B63B 21/20; E02B 3/24
USPC ..... 114/230.1, 230.11, 230.2–230.3
See application file for complete search history.

(56) References Cited

U.S. PATENT DOCUMENTS

| | | | | | |
|---|---|---|---|---|---|
| 3,120,831 | A | | 2/1964 | Fulton | |
| 3,187,707 | A | | 6/1965 | Carbone | |
| 3,464,214 | A | * | 9/1969 | King | E02B 3/24 114/230.1 |
| 4,040,377 | A | | 8/1977 | Olsen | |
| 4,067,283 | A | * | 1/1978 | Warwick | B63B 21/00 114/230.1 |
| 4,309,954 | A | * | 1/1982 | Szuch | B63B 21/00 114/230.24 |
| 4,699,075 | A | * | 10/1987 | Tortorici | B63B 21/00 114/230.24 |
| 5,036,784 | A | * | 8/1991 | Wagner | E02B 3/24 114/230.16 |
| 5,154,132 | A | * | 10/1992 | Brushaber | E02B 3/24 114/230.11 |
| 5,762,016 | A | | 6/1998 | Parsons | |

* cited by examiner

*Primary Examiner* — Ajay Vasudeva

(57) ABSTRACT

A steady mooring whip includes a lower mooring whip arm mounted below a standard traditional mooring whip. The lower whip arm can be mounted directly to a dock or seawall, and can extend below the base of the mooring whip. By having a point below the traditional mooring whip, the system can have a loop of line between the vessel, the traditional upper mooring whip, and the additional lower mooring whip arm. This loop allows for consistent tension in the line and in the upper mooring whip arm, even as tidal conditions fluctuate.

13 Claims, 10 Drawing Sheets

STEADY DOCKING WHIP

RELATED APPLICATION

This application claims the benefit of U.S. Patent Application Ser. No. 63/155,703, entitled STEADY DOCKING WHIP, filed Mar. 2, 2021, the teachings of which are expressly incorporated herein by reference.

FIELD OF THE INVENTION

This invention relates to docking whips, and more particularly, to docking whips for use in tidal areas.

BACKGROUND OF THE INVENTION

When a vessel is secured to a dock or seawall, there is potential for wind, currents, waves, wakes, storms, and other factors to cause the vessel to collide with, or rub against, the dock or seawall. Such contact between a vessel and dock or seawall can cause damage to the vessel, and even the dock or seawall. A number different products have attempted to mitigate this problem.

One attempt at mitigating the problem is a mooring whip, such as the one described in U.S. Pat. No. 4,040,377, titled MOORING WHIP BASE. Mooring whips are intended to prevent contact between a vessel and a dock or seawall through the use of tension. Tension is created by tethering the vessel to a flexible rod which is mounted to the dock or seawall at an angle so that one end hangs above the vessel. The downward force of the vessel creates tension in the flexible rod, which is intended to resist the force of wind, currents, wakes, and other factors which may cause the vessel to collide with, or rub against, the dock or seawall.

When the whip has insufficient tension, such as during a rise in the tide, the mooring whip can become ineffective at preventing contact between a vessel and dock or seawall. As the tide rises, the downward force of the vessel on the whip is reduced, which results in the tension being released from the flexible rod.

Different products have attempted to overcome the problem caused when high tides release the tension in a mooring whip. One attempted solution involves a flexible mounting base for the mooring whip, such as the bases described in U.S. Pat. No. 3,187,707, entitled MOORING WHIP ANCHORING MEANS, and U.S. Pat. No. 3,120,831, entitled MOORING WHIP. These patents describe an adjustable whip mount that allows the positioning of the flexible rod to change with tidal levels. Another attempted solution replaces the mooring whip with a sliding tether between a vessel and dock, such as described in U.S. Pat. No. 5,762,016, entitled DOCK POLE BUMPER ASSEMBLY. Both of these approaches require the boat owner to abandon previous mooring whip systems, and replace them with an entirely new system that may be only marginally more effective.

Accordingly, it would be desirable to provide a system for mooring a boat to a dock or seawall that can prevent contact between the boat and the dock regardless of waves, changes in tides, or other factors. It would be further desirable if the system for mooring a boat that can prevent contact between the boat and the dock regardless of waves, changes in tides, or other factors, could also be compatible with previously existing systems.

SUMMARY OF THE INVENTION

This invention overcomes disadvantages of the prior art by providing a system and method for mooring a boat to a dock or seawall and preventing contact between the boat and the dock or seawall regardless of waves, wind, currents, changes in tides, wakes, storms, or other factors. This system is also compatible with previously existing whip systems so that a boat owner can enjoy the benefits of this invention without needing to replace traditional mooring whips.

In an illustrative embodiment, a method of mooring a boat to a dock can provide the steps of (a) tying a line to a vessel (also herein termed "boat"), passing the line through an upper pulley on an upper mooring arm, the upper mooring arm extended out from the dock and above the boat, (b) passing the line through a lower pulley on a lower mooring arm, the lower mooring arm extending down at an angle from the dock towards the sea floor, and (c) tying the line back to the boat to form a loop of line that starts and ends at the boat.

In an illustrative embodiment, a system and method is provided for mooring a boat with a line tied to the boat. An upper mooring arm extends from a location adjacent to the dock to a location approximately over the boat, and includes an upper pulley that receives the line, which passes therethrough. A lower mooring arm extends downward at an angle from the dock toward the sea floor, and includes a lower pulley that receives the line, which passes therethrough. The line is thereby arranged to define a loop that starts and ends at an attachment location on the boat; and more particularly, the line defines a complete loop between three points that maintains tension as long as the line moves in a first direction but releases tension by disengaging a hinge when the line moves in an opposite, second direction. The first direction and the second direction can be each of opposing rising and falling sea level, respectively. Illustratively, a tensioner can be connected on the line that is arranged to allow tension of the line to be varied. A mounting plate can be provided, which is constructed and arranged to secure to a dock, and that supports a proximal end of the lower mooring arm and includes a pulley that movably guides the line. The mounting plate can define an approximately L-shaped base and a whip carrying section hingedly attached, by an appropriate hinge assembly, to the base that engages the proximal end of the lower mooring arm using a hinge. A low anchor point can be defined, which depends below the boat to generate tension in the line under predetermined tidal conditions. The low anchor point can be constructed and arranged to maintain tension in the upper mooring arm under predetermined tidal conditions. Likewise, the whip carrying section can be constructed and arranged so that, as sea level drops, the hinge releases tension and the low anchor point drops into an orientation approaching one perpendicular to a surface of the sea. At least one of the upper mooring arm and the lower mooring arm can comprise a resilient, water-resistant material-including, but not limited to, at least one of aluminum alloy, fiberglass, carbon-fiber, glass-filled nylon, solid wood and laminated wood.

BRIEF DESCRIPTION OF THE DRAWINGS

The invention description below refers to the accompanying drawings, of which.

DETAILED DESCRIPTION

Traditional mooring whips are flexible rods, mounted at an angle to extend out over a mooring area, also called a docking area. A boat owner can park a boat near, but not touching, a dock, seawall, etc., and then tie the boat to the end of the mooring whip. The boat owner flexes the end of the whip downwards towards the boat, and ties the boat to the whip while the whip is flexed downward. In this way, the boat is tied to the end of the whip which is positioned above the boat, and out and away from the dock. By tying the boat to the end of the whip, distant from the dock, the boat is held out and away from the dock.

In traditional mooring whip usage, the distance between the boat and the end of the whip, plus the available play in the whip, needs to be sufficiently small to hold the boat out and away from the dock. If the boat is tied too far from the end of the whip with an excessive length of rope, or if the whip is not sufficiently tensioned and is allowed too much play the boat can make contact with the dock, resulting in damage to the boat and/or dock.

When a boat owner ties the boat to a traditional whip with a sufficiently short length of rope between the boat and the end of the whip, the whip can be pulled down in the flexed and downward-curved state, and held there by the weight of the boat. That tension in the whip with the whip in the curved downward position allows the whip to maintain the boat out and away from the dock. The flexible, but tensed, whip can allow some movement to absorb various waves and wakes, while not allowing the boat to move enough to contact the dock.

These traditional (conventional, and/or according to prior art configurations) mooring whip systems fail to keep boats safely out of contact from a dock during rising tides because the whip cannot maintain tension when the tide rises. As the rising tide lifts the boat higher, the mooring whip begins to straighten and lose tension. This loss of tension in the whip results in increased play in the system, which allows the boat greater lateral movement, including movement towards and into the dock. Falling tides also create problems, as the whip must be able to flex all the way down to the lowest tide levels as the boat sinks relative to the dock. A traditional whip that can flex sufficiently to accommodate the lowest tide levels may have too much play at a range of higher tide levels.

Figure 1:
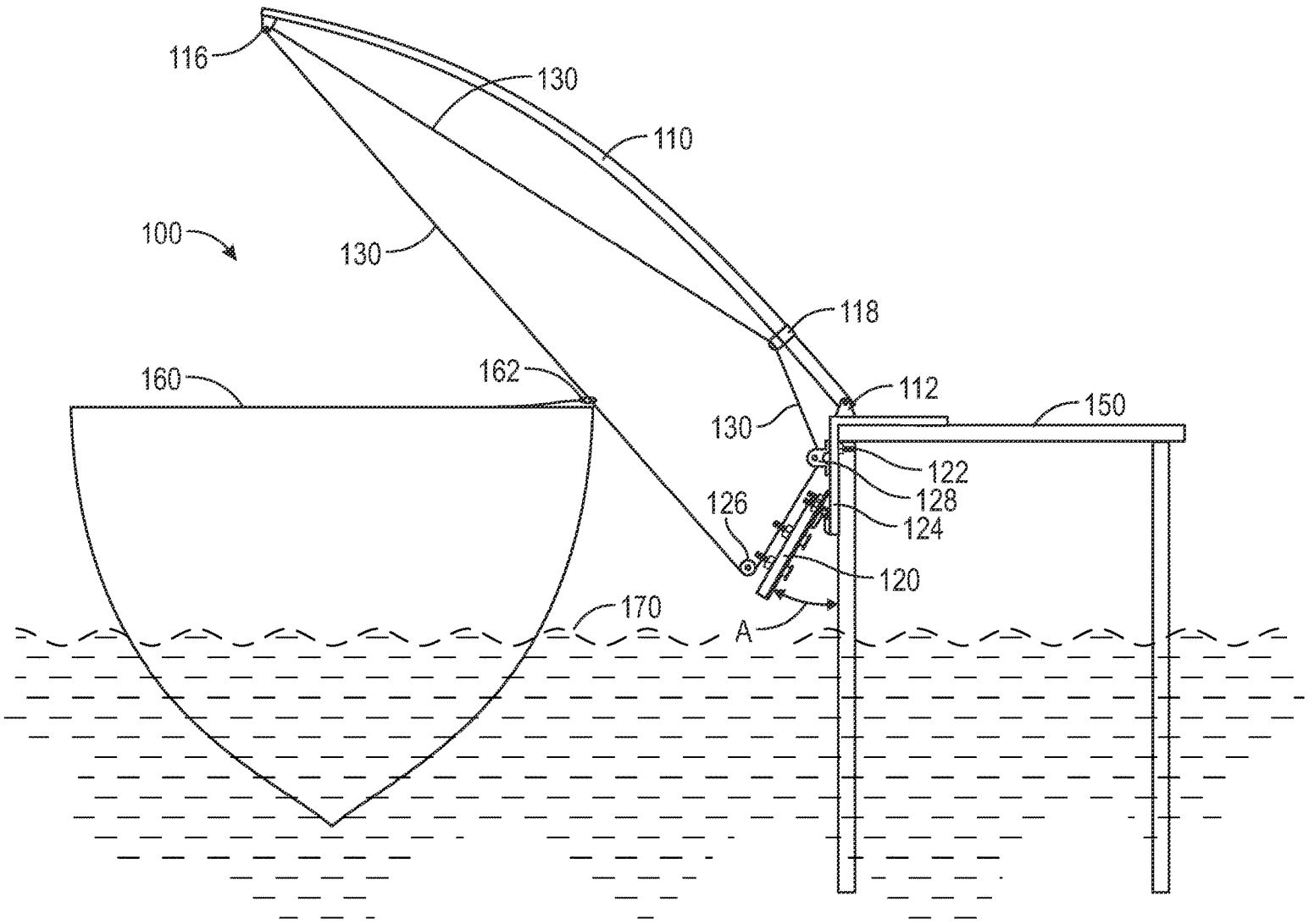
FIG. 1 is as a diagrammatic view of a boat moored to a dock with a traditional mooring whip and a lower mooring arm, according to an illustrative embodiment.

Adding a second whip arm that can operate in concert with the traditional whip can alleviate the problems inherent in the single-arm whip system described above. FIG. 1 is as a diagrammatic view of a boat moored to a dock with a mooring whip and a lower mooring arm, according to an illustrative embodiment. A dual-arm whip system 100 can incorporate a lower connector, such as lower arm 120, that can work together with the upper arm 110 to maintain consistent tension in the line 130 and overall whip arrangement to ensure that the boat 160 cannot contact the dock 150. The upper arm 110 can be a traditional mooring whip, as described above. A boat owner can add a lower arm 120 to the dock 150 to improve the performance of the traditional whip 110, or a boat owner can install a complete system with upper and lower arms at the same time.

The upper arm 110 can be mounted to the dock 150 with an upper whip bracket 112 that maintains the whip at a fixed angle relative to the dock. By way of non-limiting example, the upper whip bracket can point the upper whip 110 approximately 45° up and away from the dock. The bracket 112 can also maintain the whip at a fixed orientation pointing directly outward from the dock toward the water. The upper arm has an upper pulley 116 at the distal end of the upper arm to accommodate a rope, or line 130.

The lower arm 120 can have a lower bracket 122 that can permanently attach the lower arm to the side of the dock (or as described further below, the whip arrangement can employ a hinging bracket assembly secured to the dock), and holds the lower arm 120 in a downward orientation, at an angle A extending out from the dock and towards the sea floor. In various embodiments, the lower arm can be attached to, and extend out from, the side of a dock, the top surface of a dock, the bottom of a dock, a support pillar anchoring the dock into the ground, a sea wall, or various other anchor points so that the lower arm is positioned under the upper arm. The lower bracket 122 can be attached to the dock or seawall using heavy bolts or other means that can be similar to the means for attaching the upper whip to the dock. The lower arm 120 can be connected to the lower bracket 122 with a hinge 124. Hinge 124 can allow the lower arm a range of movement between a relaxed state, which can include hanging vertically at 0° from the side of the dock, and a maximum angle A extending out from the dock when the lower arm is in a tensed state. By way of non-limiting example, in various embodiments angle A can be in a range from 0° to 90° from the side of the dock. In various embodiments angle A can be in a range from approximately 40° to approximately 50° from the side of the dock. In various embodiments angle A can be approximately 45° from the side of the dock. Although the angles can be different in different embodiments, the hinge allows a limited range of movement that prevents the lower arm from swinging upward beyond a predetermined angle.

The lower arm 120 can have a lower connection point, such as lower pulley 126 at the distal end of the lower arm to accommodate the line 130. The system can also have a dock pulley 128 that can be mounted directly to the dock 150 or the lower bracket 122. The line 130 can be a single length of line that passes through the upper pulley 116, the dock pulley 128, and the lower pulley 126.

A boat owner can tie both ends of the line to a cleat 162 on the boat 160, so that the line 130 forms a loop from the boat, through the upper and lower pulleys, and back to the boat. The boat owner can tie both ends of the line to the cleat with sufficient tension to pull the distal end of the upper arm downwards toward the boat. The flexed upper arm can maintain the tension in the line after the line is tied to the cleat. As shown in FIG. 1, the line 130 can also optionally pass through the dock pulley 128 and/or a tensioner 118 on the upper arm 110. A boat owner can moor a boat with a desired level of tension by pulling the rope taut and/or pulling down on the distal end of the whip while tying the rope 130 to the cleat 162. A system with more tension has the whip flexed down closer to the boat, and vice versa.

A boat owner may choose to adjust or increase the tension in the line after exiting the boat by using the tensioner 118. In various embodiments, the tensioner can allow the user to increase or decrease the distance between the line and the upper arm at the tensioner, thereby decreasing or increasing the tension, accordingly. In various embodiments, the tensioner 118 can be a simple binary control so that the rope does or does not pass through the tensioner, resulting in a more tense state and a less tense state. A boat owner may set a first level of tension in the line while the owner is on the boat, and then increase the tension by pulling the line 130 into the tensioner 118. In various embodiments, a binary tensioner can be a simple loop with a hinged opening, similar to a carabiner, so that the user can quickly adjust between having the line pass through the tensioner or not pass through the tensioner. When the user returns to the boat to leave the dock, the user can use the tensioner 118 to release at least a portion of the tension, so that the boat will be easier to untie and release. In the case of a binary control tensioner, the user can simply release the line 130 from the tensioner, so that the distance between the line 130 and the upper arm 110 at the tensioner increases, thereby releasing at least a portion of the tension in the line 130. A non-binary tensioner can allow the user to adjust the distance between the line and the upper arm 110 through a range of distances that allow the user to adjust through a range of tensions after tying up the boat.

Figure 2:
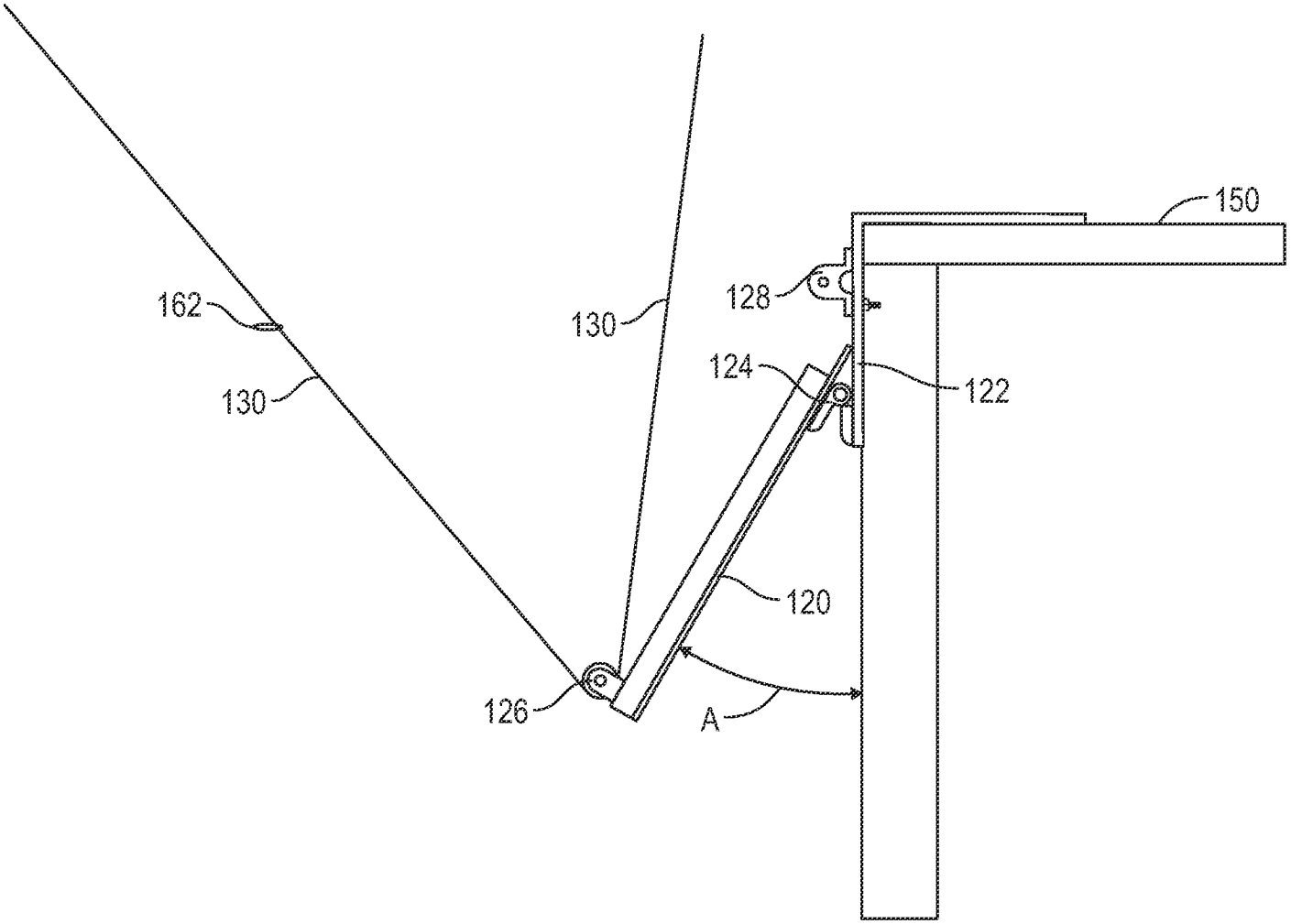
FIG. 2 is an enlarged view of the lower mooring arm of FIG. 1 in a tensed state, according to an illustrative embodiment.

FIG. 2 is an enlarged view of the lower mooring arm of FIG. 1 in a tensed state, according to an illustrative embodiment. As shown, hinge 124 prevents the lower arm 120 from pivoting away from the side of the dock beyond a fixed angle A. The lower arm 120 can pivot freely between angle A in a tensed state, and a relaxed state at an angle less than angle A that can be resting flat against the side of the dock at 0° in some embodiments. When line 130 has sufficient tension, the lower arm is held in the tensed state shown in FIG. 2. As shown in FIG. 2, the line 130 is not required to pass through the dock pulley 128. FIG. 2 shows the system in a tensed state with the line connecting from a first boat cleat 162 through the lower pulley 126, through the tensioner 118 (not shown), through the upper pulley 116 (not shown), and back to the boat 160 to form a tensioned loop. The tension on the line 130 holds the lower arm 120 out from the side of the dock at angle A. In various embodiments, the lower arm 120 can flex under tension, similar to the upper arm.

Figure 3:
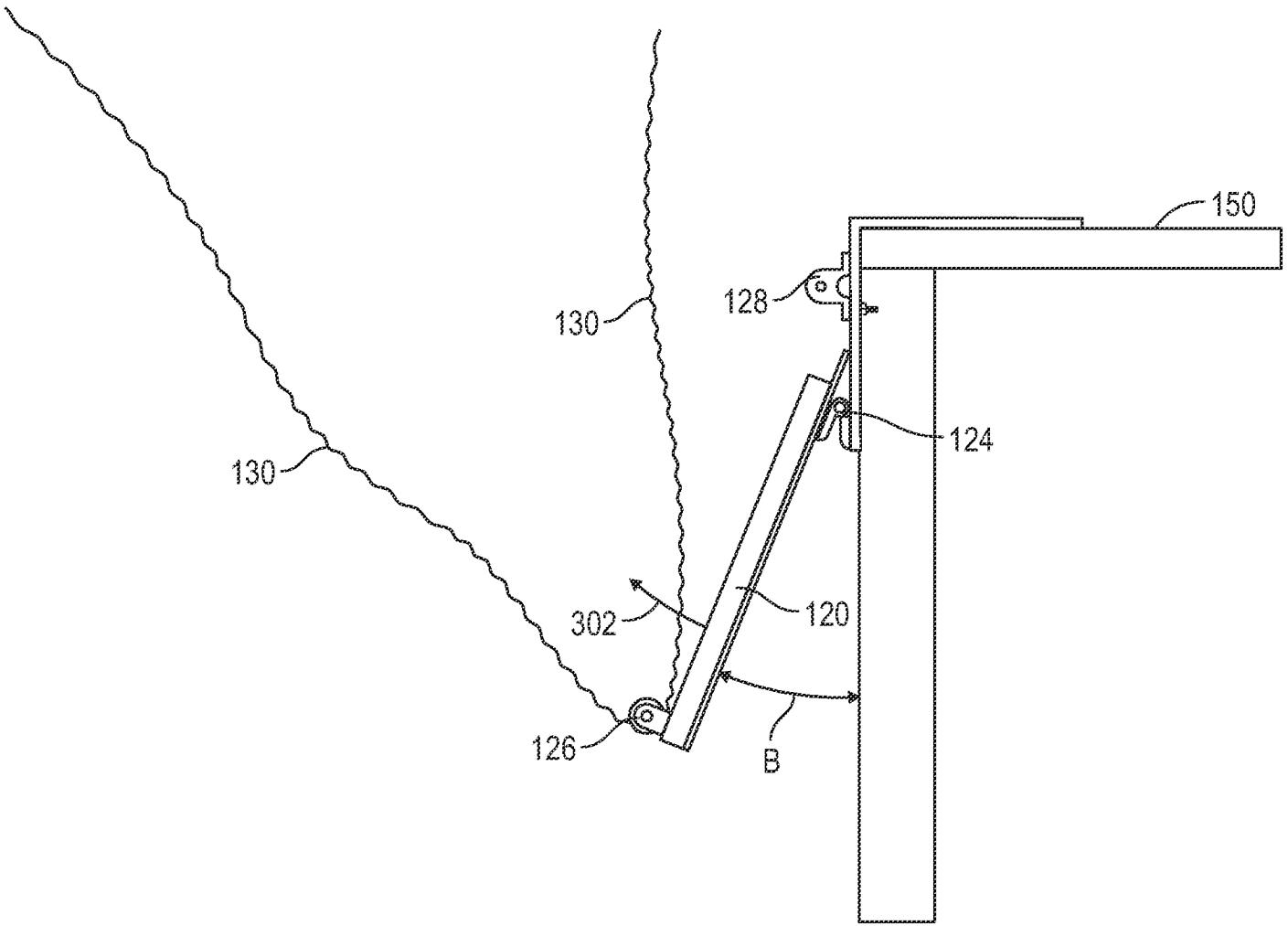
FIG. 3 is an enlarged view of the lower mooring arm of FIG. 1, shown in a relaxed state, according to illustrative embodiments.

FIG. 3 is an enlarged view of the lower mooring arm of FIG. 1, shown in a relaxed state, according to illustrative embodiments. As shown, hinge 124 permits the lower arm 120 to pivot downwards and out of the way when not in use. When the lower arm 120 is in a relaxed state, the lower arm can pivot downwards to an angle B from the side of the dock. In various embodiments, angle B can be as low as 0° from the side of the dock.

Figure 4:
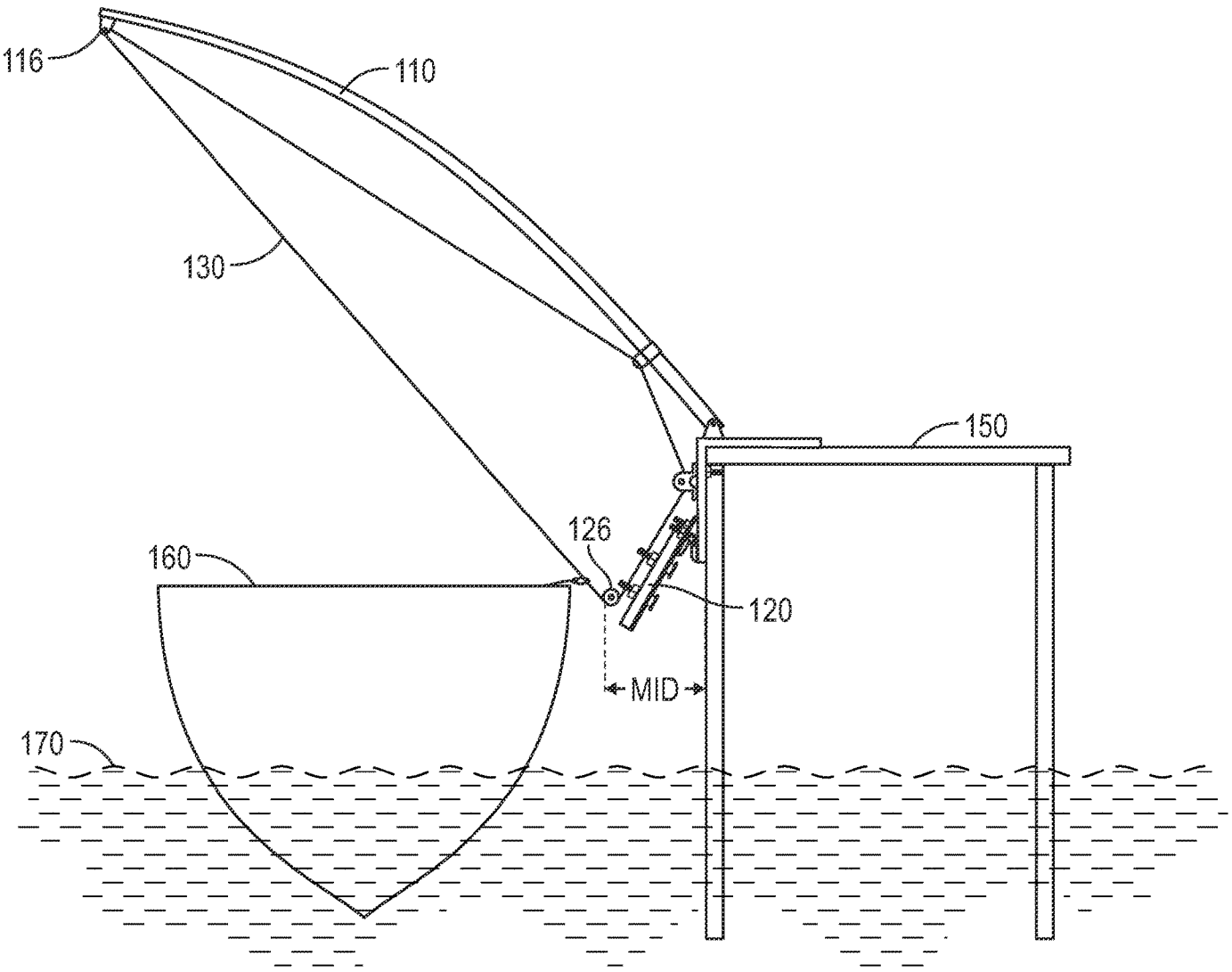
FIG. 4 is a diagrammatic view of a boat moored to a dock with a mooring whip and a lower mooring arm during low tide, according to an illustrative embodiment.

When tension is applied to the line 130, the lower arm 120 can be pulled upwards along arrow 302 into the elevated position shown in FIG. 2. When the lower arm is not in use, it pivots downward into a position that keeps the lower arm out of the way when a boat is approaching and leaving the dock. The upper arm can remain fixed at a predetermined angle, and does not need to move, however, the lower arm, which may be unseen under the surface of the water, can pivot away in various embodiments to avoid damage to boats that are docking and undocking. FIG. 4 is a diagrammatic view of the boat moored to the dock with a mooring whip and a lower mooring arm during low tide, according to an illustrative embodiment. As the tide goes out and the water level 170 falls, the line maintains tension similar to the tension shown in FIG. 1. FIG. 4 shows the same boat 160 as shown in FIG. 1, moored to the same upper arm 110 and lower arm 120 that are affixed to the same dock 150, and with the same level of tension in the line 130. The lower arm 120 is held in the same tensed, elevated position, and the upper arm 110 is flexed downward under the tension, held in the same position as shown in FIG. 1. Similar to FIG. 1, the line starts at the boat 160, and passes through upper pulley 116 and lower pulley 126, and back to the boat 160, forming a loop. This loop allows for consistent tension, even as tidal conditions fluctuate. More particularly, at low tide (and/or lower se level), arm 120 is typically relatively relaxed, and hangs/depends perpendicularly to the dock. That is, as the tide/sea level rises, the tension on the arm 120 increases, and conversely as tide/sea level drops, the arm 120 tension slacks and it hangs more freely The loop of line can slide through the pulleys so that the position of the boat relative to the dock can change with the tide, while other components remain in the same locations and orientations. A boat owner who moors his boat as shown in FIG. 1 may return later in the day during low tide to find that the boat is moored as shown in FIG. 4. The lower arm, upper arm, and loop of line form a system that maintains the same level of tension, and holds the boat at the dock, without allowing the boat to contact the dock. The lower arm sets a minimum distance MID between the dock and the end of the lower arm that the boat is maintained away from the dock. Under low tide conditions, the boat is lower and closer relative to the dock, but remains safely moored to the dock. The system as shown in FIG. 4 allows the boat to move up and down with the tide, without damaging the whip, losing tension, or contacting the dock.

Figure 5:
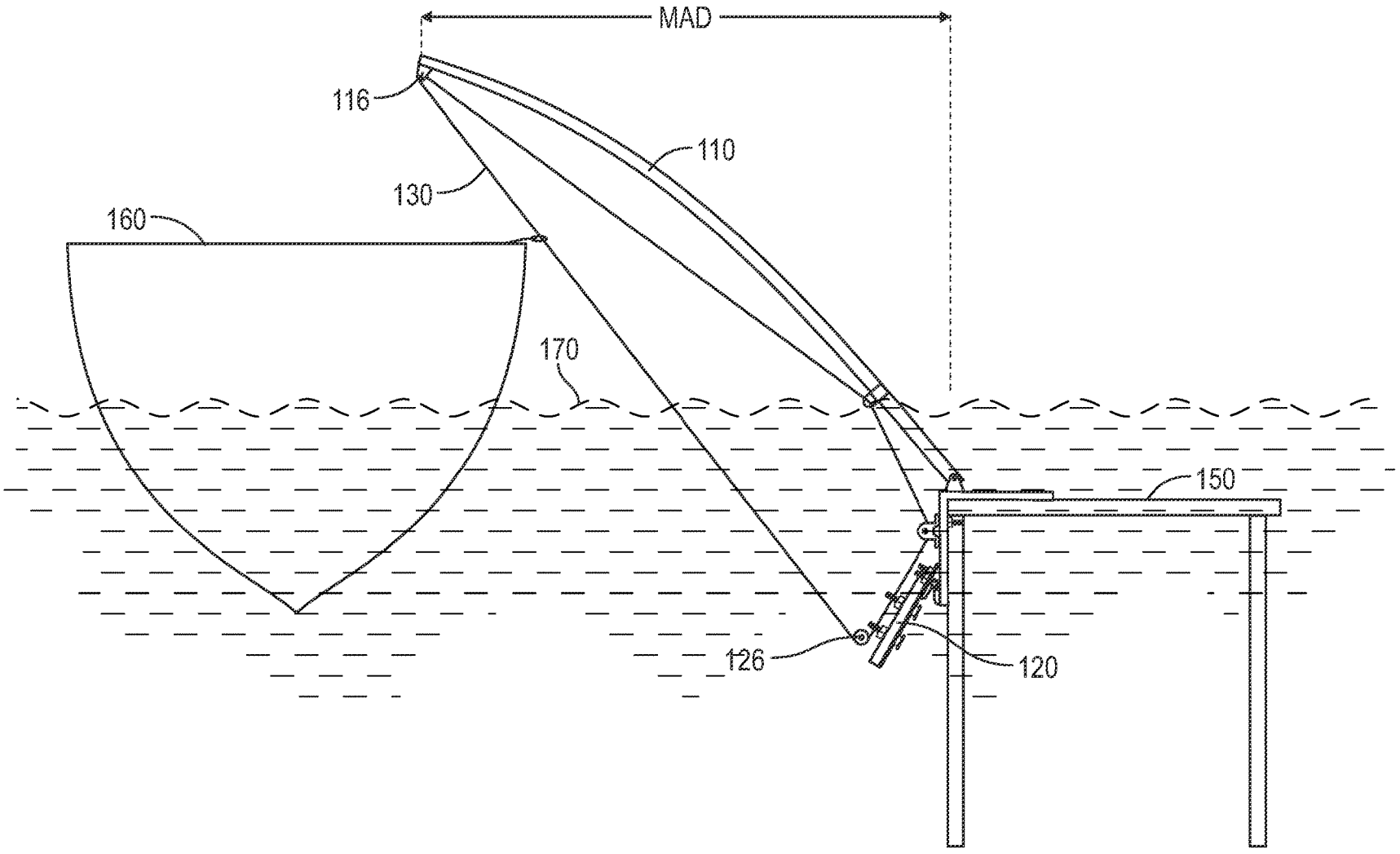
FIG. 5 is a diagrammatic view of a boat moored to a dock with a mooring whip and a lower mooring arm during a high tide caused by a storm surge, according to an illustrative embodiment.

FIG. 5 is a diagrammatic view of a boat moored to a dock with a mooring whip and a lower mooring arm during a high tide caused by a storm surge, according to an illustrative embodiment. As the tide rises, the line maintains tension similar to the tension shown in FIGS. 1 and 4. FIG. 5 shows the same boat 160, as shown in FIGS. 1 and 4, moored to the same upper arm 110 and lower arm 120 that are affixed to the same dock 150, and with the same level of tension in the line 130. The lower arm 120 is held in the same tensed, elevated position, and the upper arm 110 is flexed downward under the tension, held in the same position as shown in FIGS. 1 and 4. Similar to FIG. 1, the line starts at the boat 160, and passes through upper pulley 116 and lower pulley 126, and back to the boat 160, forming a loop.

The loop of line can slide through the pulleys so that the position of the boat relative to the dock can change with the tide, while other components remain in the same locations and orientations. A boat owner who moors his boat as shown in FIG. 1 may return later in the day during high tide to find that the boat is moored as shown in FIG. 5. The lower arm, upper arm, and line form a system that maintains the same level of tension, and holds the boat at the dock, without allowing the boat to contact the dock. With the dual-arm system, the upper arm 110 can set a maximum distance MAD that the boat is maintained away from the dock. As shown, the boat is higher and farther away relative to the dock, but remains safely moored to the dock. The system as shown in FIG. 5 allows the boat to move up and down with the tide, without damaging the whip, losing tension, or contacting the dock.

As shown in FIGS. 4 and 5, the system 100 can maintain the boat safely moored to the dock, while preventing contact with the dock, at a wide range of water levels, including very low tide as shown in FIG. 4, and storm surge high tide, as shown in FIG. 5 with water levels 170 higher than the dock. Advantageously, during storm surge conditions, the rising water levels naturally result in the boat moving upward and outward away from the dock, which results in an increased distance between the boat and the dock during a storm surge. This increased distance between the boat and the dock further reduces the possibility of the boat being damaged against the dock during violent storm conditions, such as strong wind and/or waves.

During all tidal conditions, the line can slide through the pulleys, allowing the boat to remain in the same orientation, so that the mooring system does not provide forces causing the boat to rock or tip. Similarly, the upper and lower arms also remain in the same orientation, with no change in force on the upper and lower arms after the boat owner has moored the boat and fixed the amount of tension in the line.

Figure 6:
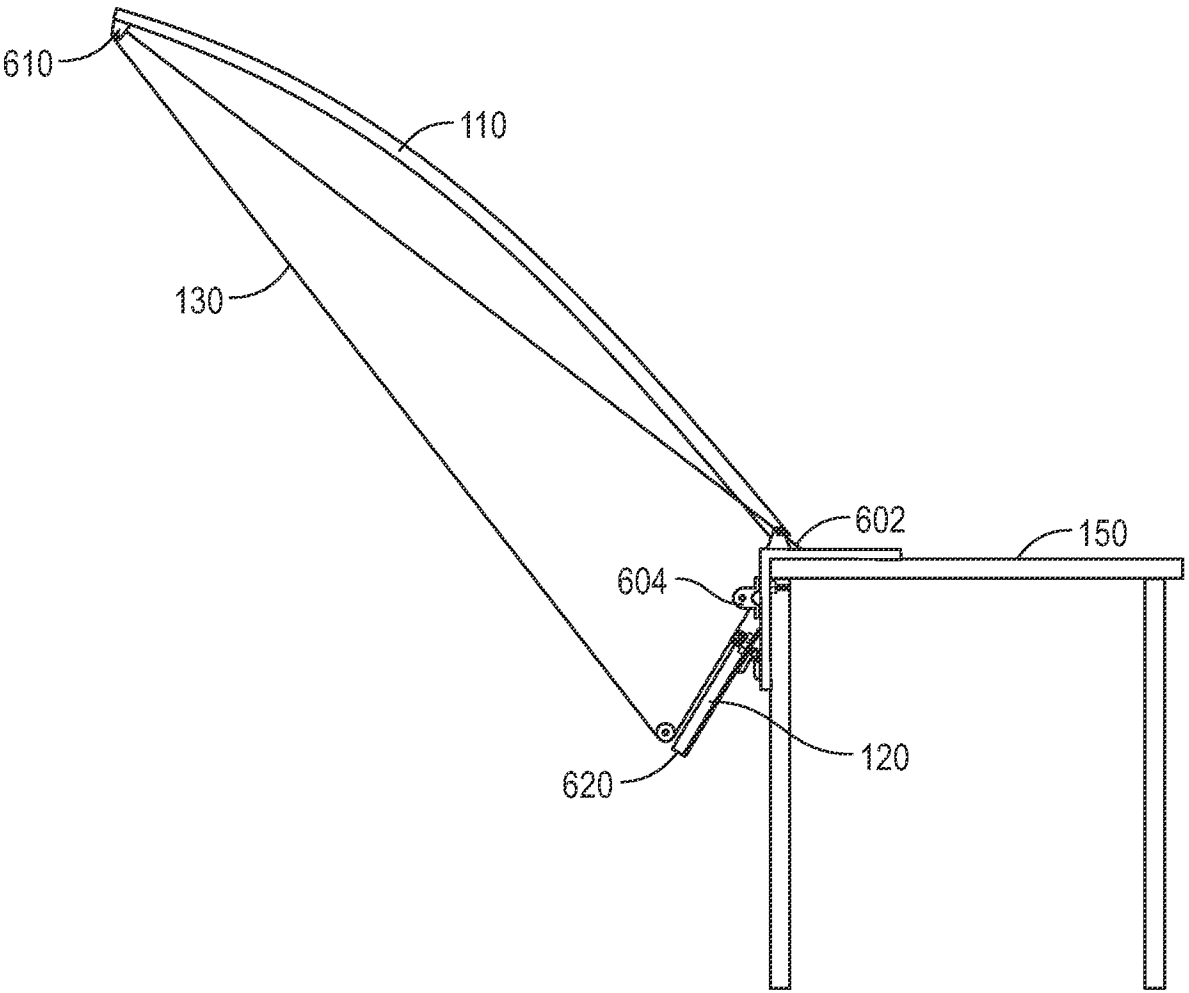
FIG. 6 is a diagrammatic view of a dual-arm whip system with a line that starts and ends at the dock, according to an illustrative embodiment.

FIG. 6 is a diagrammatic view of a dual-arm whip system with a line that starts and ends at the dock, according to an illustrative embodiment. As described above, the line 130 is described as forming a loop that starts at the boat and ends at the boat. However, in various embodiments, the line 130 can start at the dock and end at the dock, can start and end at the upper pulley, or can start and end at any point around the path of the loop of line 130. Although the line 130 is sometimes described herein as forming a loop that can slide through the various pulleys in the system, the ends of the line can also be secured to one or more fixed locations, including attaching the two ends of the line to two separate fixed locations.

As shown in FIG. 6, a first end 602 of the line 130 is attached to the top of the dock 150 and the second end 604 of the line 130 is attached to a lower portion of the dock. In various embodiments, both ends 602, 604 of the line 130 can be attached to the same cleat on the dock, or can be attached to the dock in two different locations as shown in FIG. 6. In embodiments such as the one shown in FIG. 6, a boat can be slidably attached to a section of line 130 that can extend between the end 610 of the upper arm 110 and the end 620 of the lower arm 120. The boat can attach to the line 130 with a loop such as a loop of rope around the section of line 130, or a carabiner that can open and close so that it can be slidably secured around the line 130, or various other means for slidably connecting the boat to the line, so that the boat can travel up and down along the line segment between the ends 610, 620 of the arms 110, 120. Because the boat can move between the two ends 610, 620 of the arms 110, 120, the boat is able to move up and down with changing water levels and the tension in the dual-arm whip system remains constant.

In various embodiments, the first end of the line can be affixed at any point along the loop, including, but not limited to the boat, and the second end of the line can be affixed at any point along the loop, including, but not limited to the boat (e.g. a cleat or other attachment point). In an embodiment, the first end 602 of the line 130 can be tied or otherwise attached to the end 610 of the upper arm 110. In an embodiment, the second end 602 of the line 130 can be tied or otherwise attached to the end 620 of the lower arm 120. In various embodiments, the first and/or second ends of the line 130 can be tied or otherwise attached to the dock 150. Releasing either the first end 602 or the second end 604 of the line 130 can allow the lower arm 120 to pivot downwards and out of the way, so that a boat can approach close to the dock without risk of contacting the lower arm 120.

Figure 7:
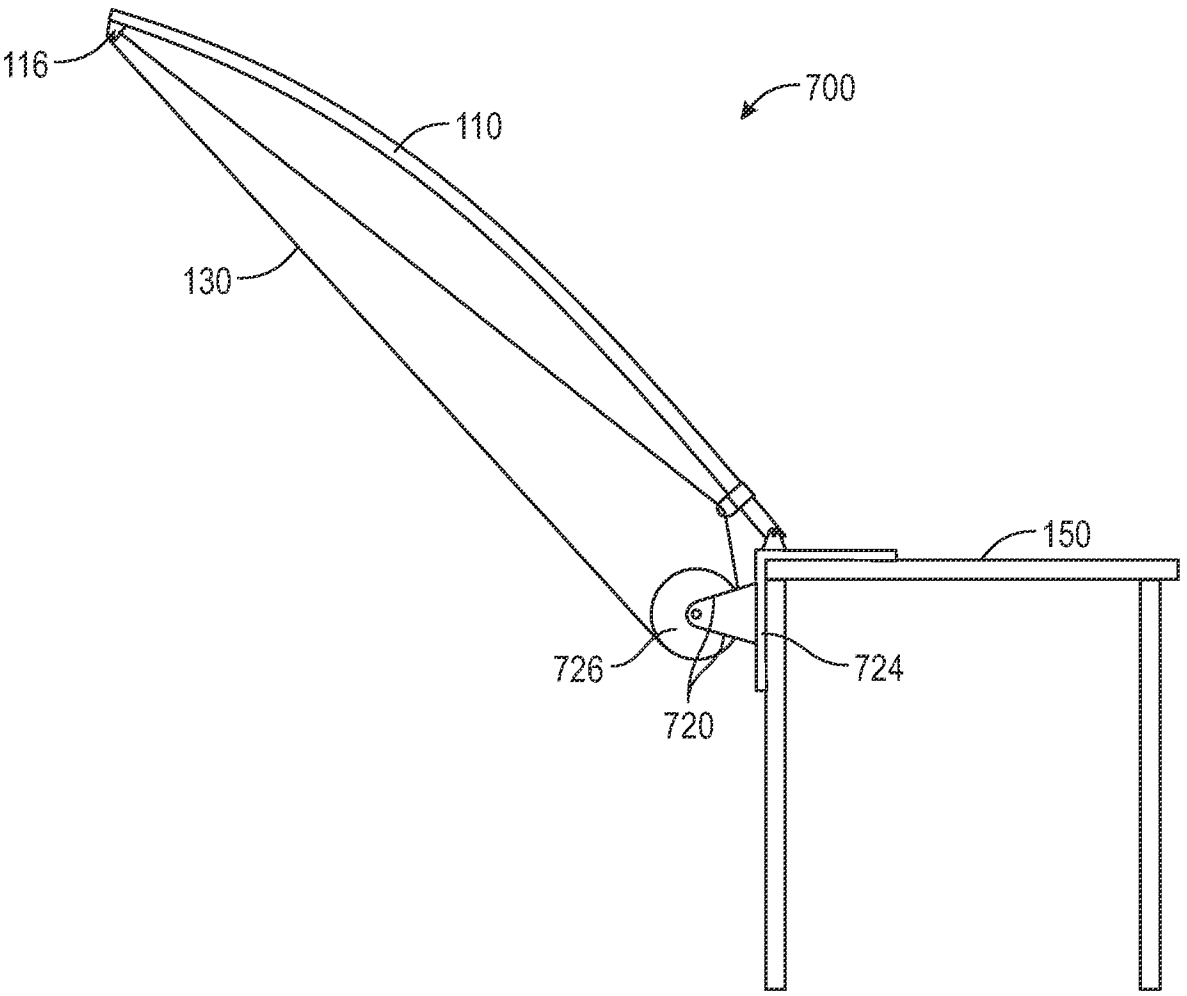
FIG. 7 is a diagrammatic view of a dual-arm whip system with a large lower pulley, according to an illustrative embodiment.

FIG. 7 is a diagrammatic view of a dual-arm whip system with a large lower pulley, according to an illustrative embodiment. A dual arm whip system 700 can have one or more short lower connectors, such as lower arms 720 that can hold various types of lower connection points, such as a large pulley, or wheel 726. The short lower arm 720 can be non-flexible, and can have a hinge 724 that allows the lower arm 720 and wheel 726 to swing from side to side. As a boat approaches the dock, the lower arm 720 and wheel 726 can swing to the side so as to avoid interference with the boat's approach in the vicinity of the dock. When the boat is moored to the dock, tension in the line 130 can pull the lower arm 720 and wheel 726 into position under the upper arm 110, as shown in FIG. 7. The line 130 can slide through the pulleys and around the wheel 726, so that the boat can travel between the end of the upper arm 110 and the end of the lower arm 120 as the tide rises and falls.

Similar to the above descriptions, the ends of the line 130 can be attached at various different locations around the system, including the same or different locations. This can include forming a loop of line 130 that starts and ends at the boat or various other locations, and in various embodiments can include starting at a first location and ending at a second location. The large wheel 726 can function similar to the lower pulley of FIG. 1, allowing a loop line to travel around the system as the tide rises and falls. In embodiments having the ends of the line 130 attached at locations that are not on the boat, the boat can be slidably attached to the line so that the boat can travel between the end of the upper arm 110 and the end of the lower arm 120 as the tide rises and falls.

Figure 8:
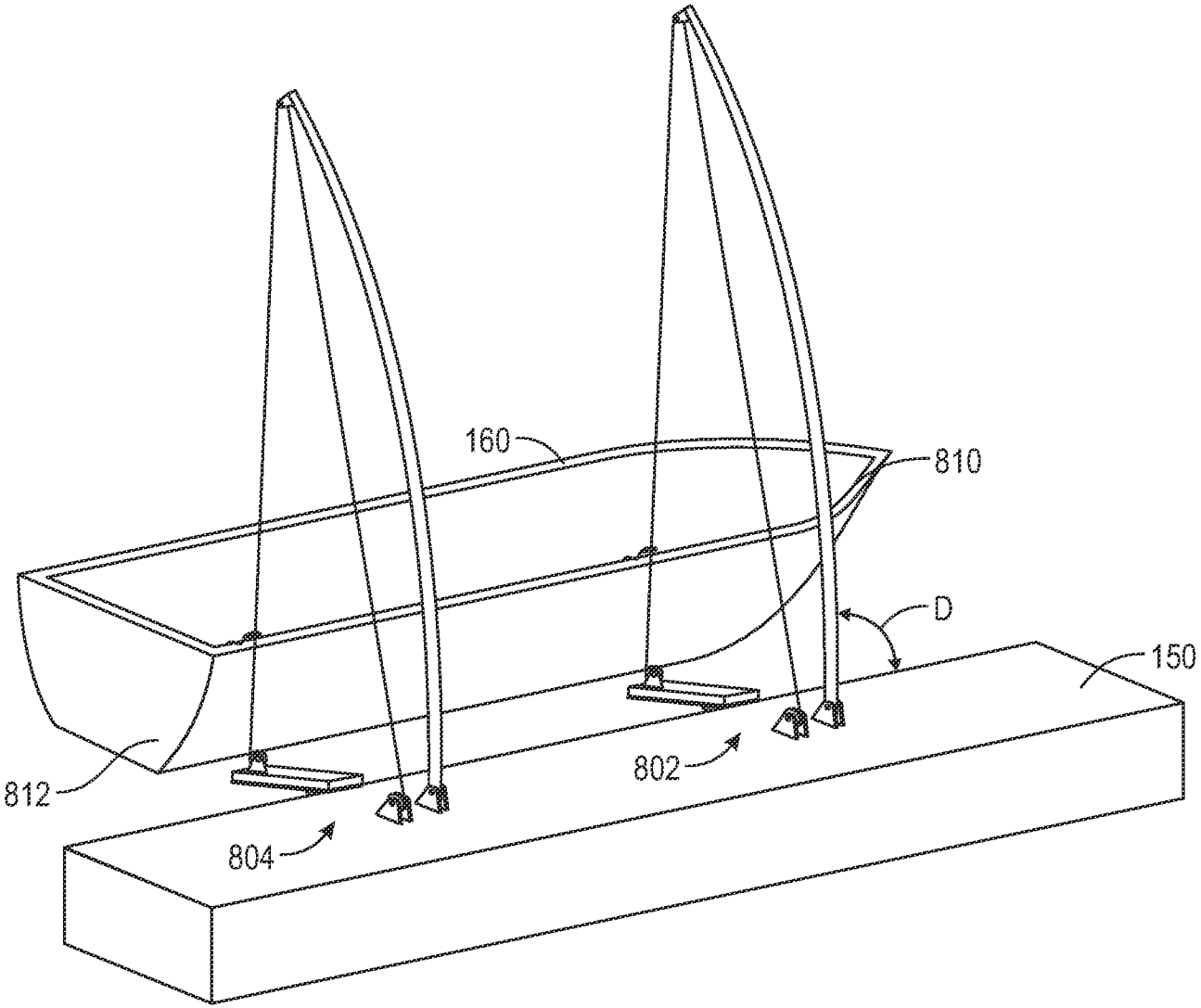
FIG. 8 is a diagrammatic view of a dual-arm whip system having two sets of mooring arms, according to an illustrative embodiment.

FIG. 8 is a diagrammatic view of a dual-arm whip system having two sets of mooring arms, according to an illustrative embodiment. In a typical arrangement, a dual-arm mooring system will include two or more sets of dual-arm mooring whips, as shown in FIG. 8. A first set of dual-arm mooring whips 802 can secure the front of the boat 160, and a second set of dual arm mooring whips 804 can secure the rear of the boat 160. Having two or more sets of dual-arm mooring whips ensures that the boat 160 does not spin in place and contact the dock 150 with the bow 810 or rear corner 812 of the stern. Each of the four arms typically extend outward from the dock 150 at an arm angle D. Arm angle D can be an angle in a range between approximately 45° and approximately 90°. For the sake of clarity, the above figures each depict a single set of dual arm mooring whips, each with a single upper arm and a single lower arm, however, it should be clear that all embodiments will have two sets of dual-arm mooring whips, including two upper arms and two lower arms. Having two or more sets of mooring whips can help to prevent the boat from contacting the dock.

Figure 9:
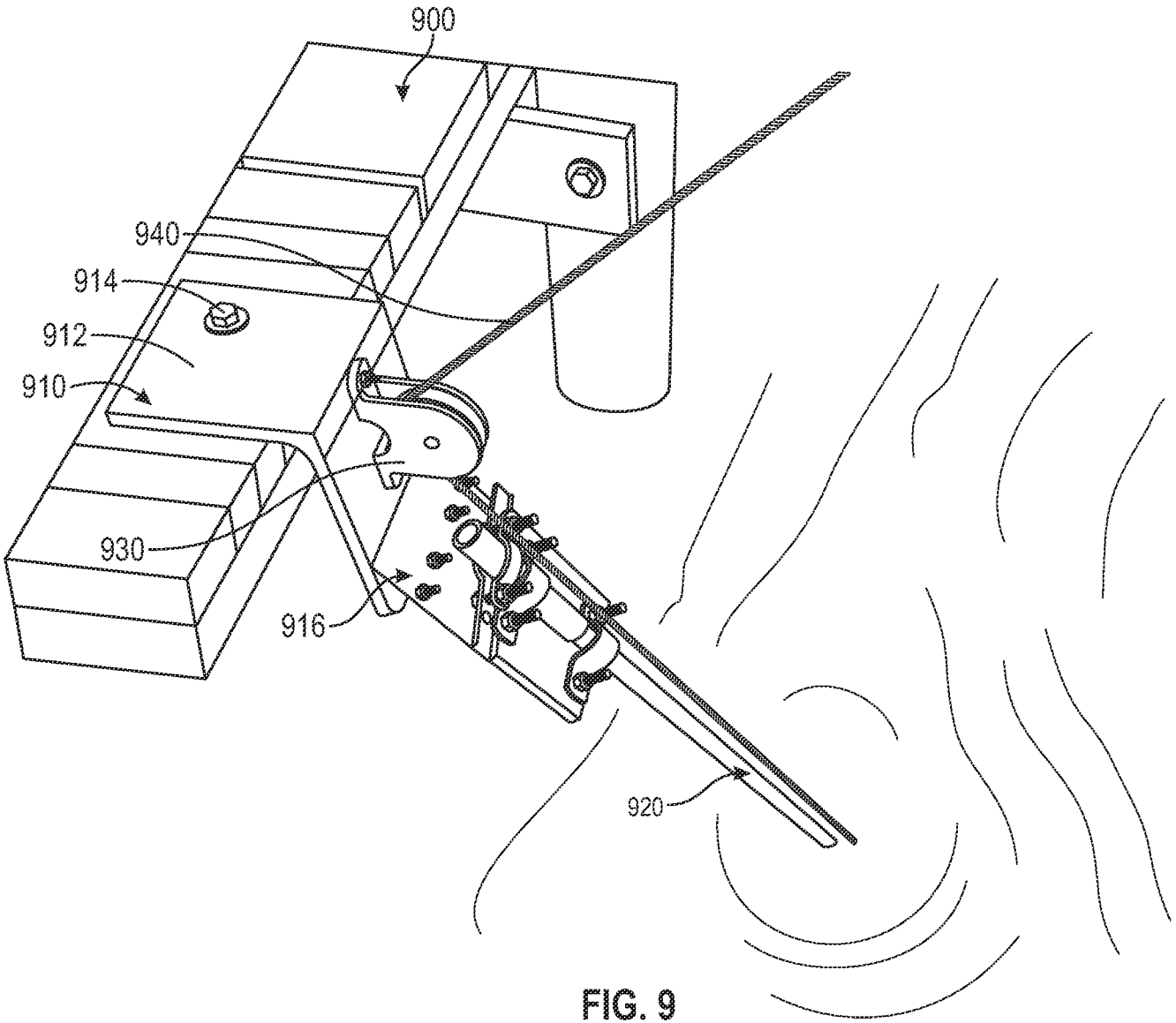
FIG. 9 shows a diagram of the lower mooring arm secured by an exemplary mounting plate to a dock.
Figure 10:
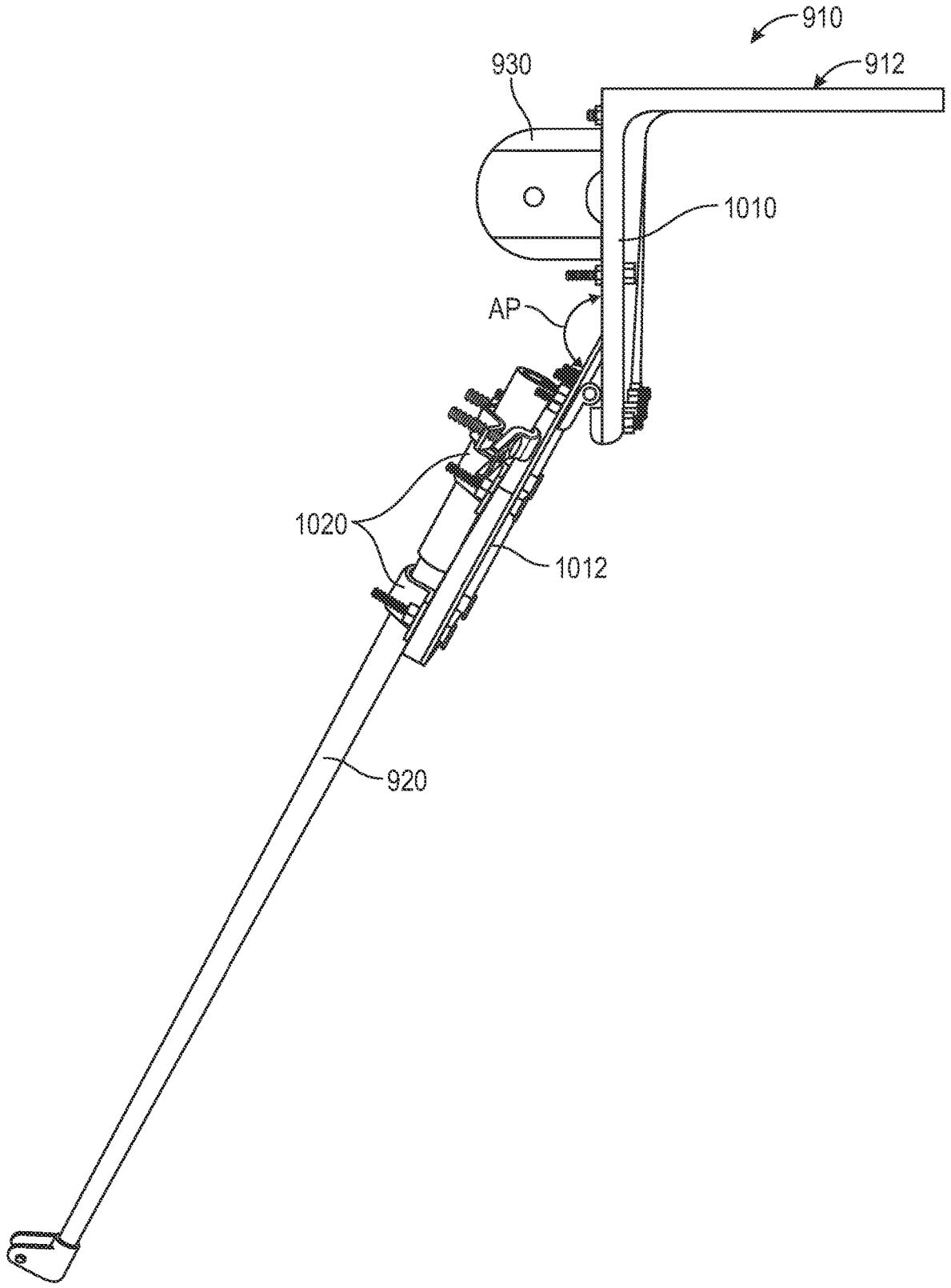
FIG. 10 is a side view of the lower mooring arm and mounting plate of FIG. 9.

Reference is now made to FIGS. 9 and 10, which show a version of the mooring whip lower mooring arm 920 herein mounted (FIG. 9) to an exemplary dock 900. The device is mounted to the dock 900 using an L shaped mounting plate 910. One end 912 of the plate 910 is mounted to the top of the dock 900 by appropriate fasteners (e.g. bolts 914, clamps, etc.), and sits parallel with the surface of the dock. The opposing end 916 extends downwardly off the side of the dock 900 at an obtuse angle AP (FIG. 10) and sits perpendicular to the dock. The end 916 defines a dogleg shape with an upper, vertical section 1010 and a lower whip-carrying section 1012, which includes a bracket assembly 1020 for securing the proximal end of the arm 920. The bracket assembly can be constructed in any accepted manner, and secured to the plate 910 with (e.g.) fasteners as shown. The upper vertical section also includes a pulley 930 for movably guiding the whip line 940 as shown in FIG. 9. The plate can be formed of any acceptable material, such as durable plastic or composite, aluminum alloy, stainless steel, etc. Note that the exemplary mounting plate 910 described herein functions essentially to secure the device to the dock.

Note that one or both of the mooring whip arms (upper and/or lower) can be constructed from a variety of resilient materials, which can undergo cyclic loading and resist moisture, weather exposure and/or salt water environments. For example, various metals, such as aluminum alloy; composites, such a fiberglass, carbon-fiber, glass-filled nylon, etc.; solid or laminated wood; or combinations of such materials can be employed. The cross section shape and size of the arm(s) is also highly variable and can be selected based upon the strength and flexibility of the material, as well as the length of the arm(s), in a manner clear to those of skill. The cross section can also vary in shape and/or size over the length of the arm(s) to allow for differential flexure, etc.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, in various embodiments, a clip-lock mechanism can connect one end of the line to the end of the upper arm, so that it can be quickly disconnected allowing the lower arm to drop out of the way, and quickly reconnected to the end of the upper arm, allowing the boat to be moored to the line. Additionally, as used herein various directional and dispositional terms such as "vertical", "horizontal", "up", "down", "bottom", "top", "side", "front", "rear", "left", "right", and the like, are used only as relative conventions and not as absolute directions/dispositions with respect to a fixed coordinate space, such as the acting direction of gravity. Additionally, where the term "substantially" or "approximately" is employed with respect to a given measurement, value or characteristic, it refers to a quantity that is within a normal operating range to achieve desired results, but that includes some variability due to inherent inaccuracy and error within the allowed tolerances of the system (e.g. 1-5 percent). Accordingly, this description is meant to be taken only by way of example, and not to otherwise limit the scope of this invention.

What is claimed is:

1. A system for mooring a boat relative to a dock with a line attached to the boat comprising:

an upper mooring arm extending from a location adjacent to the dock to a location approximately over the boat, and having an upper pulley that receives the line;

a lower mooring arm extending downward at an angle from the dock toward the sea floor, and having a lower pulley that receives the line, wherein the line is thereby arranged to define a loop that starts and ends at an attachment location on the boat; and a mounting plate that is constructed and arranged to secure to a dock and that supports a proximal end of the lower mooring arm and includes a pulley that movably guides the line, wherein the mounting plate defines an approximately L-shaped base and a whip carrying section hingedly attached to the base that engages the proximal end of the lower mooring arm using a hinge.

2. The system as set forth in claim 1, further comprising, a tensioner connected on the line that is arranged to allow tension of the line to be varied.

3. The system as set forth in claim 1 further comprising a low anchor point that depends below the boat to generate tension in the line under predetermined tidal conditions.

4. The system as set forth in claim 3 wherein the low anchor point is constructed and arranged to maintain tension in the upper mooring arm under predetermined tidal conditions.

5. The system as set forth in claim 4 wherein the whip carrying section is constructed and arranged so that, as sea level drops, a hinge releases tension and the low anchor point drops into an orientation approaching one perpendicular to a surface of the sea.

6. The system as set forth in claim 1 wherein at least one of the upper mooring arm and the lower mooring arm comprises a resilient, water-resistant material.

7. The system as set forth in claim 6 wherein the water-resistant material comprises at least one of aluminum alloy, fiberglass, carbon-fiber, glass-filled nylon, solid wood and laminated wood.

8. A system for mooring a boat relative to a dock with a line attached to the boat comprising:

an upper mooring arm extending from a location adjacent to the dock to a location approximately over the boat, and having an upper pulley that receives the line;

a lower mooring arm extending downward at an angle from the dock toward the sea floor, and having a lower pulley that receives the line; and wherein the line defines a complete loop between three points that maintains tension as long as the line moves in a first direction but releases tension by disengaging a hinge when the line moves in an opposite, second direction, and wherein the first direction and the second direction are each of opposing rising and falling sea level.

9. The system as set forth in claim 8 wherein the lower pulley is attached to a bracket along a side of the dock.

10. The system as set forth in claim 9 wherein the upper pulley is located on an end of the upper mooring arm opposite the bracket.

11. The system as set forth in claim 10 wherein the lower pulley defines an enlarged diameter wheel located proximate to the hinge.

12. The system as set forth in claim 8 wherein the upper mooring arm comprises a resilient, water-resistant material and the lower pulley comprises an enlarged wheel on a bracket along a side of the dock.

13. The system as set forth in claim 12 wherein the water-resistant material comprises at least one of aluminum alloy, fiberglass, carbon-fiber, glass-filled nylon, solid wood and laminated wood.

* * * * *